United States Patent [19]

Moore

[11] 4,264,036

[45] Apr. 28, 1981

[54] VALVE UNIT WITH DRINKING FAUCET

[76] Inventor: Roger S. Moore, 1990 Olivera Rd., Concord, Calif. 94520

[21] Appl. No.: 89,872

[22] Filed: Oct. 31, 1979

[51] Int. Cl.[3] ..... E03B 9/20

[52] U.S. Cl. ..... 239/32; 137/883; 239/444

[58] Field of Search ..... 239/24–32, 239/436, 443–447; 137/625.29, 883; 210/238, 282, 420

[56] References Cited

U.S. PATENT DOCUMENTS

| | | | |
|---|---|---|---|
| 3,342,335 | 9/1967 | Gamundi et al. | 210/282 X |
| 3,428,089 | 2/1969 | Kachergis | 137/625.29 |
| 4,147,631 | 4/1979 | Deines et al. | 210/282 X |

*Primary Examiner*—Andres Kashnikow

*Attorney, Agent, or Firm*—B. Deon Criddle; Terry M. Crellin

[57] ABSTRACT

A valve unit adapted to be attached to a faucet and to divert water from the faucet through a water purification system and to a drinking fountain formed as part of the valve unit.

7 Claims, 8 Drawing Figures

VALVE UNIT WITH DRINKING FAUCET

BRIEF DESCRIPTION OF THE INVENTION

1. Field of the Invention

This invention relates to valve units adapted to be coupled to water faucets and arranged to permit flow directly through or to divert the water as to a water purification device prior to discharge from the valve unit.

2. Prior Art

Valve units that can be attached to a faucet and that will allow flow from the faucet directly through the unit or that will divert the flow through a water purification unit before discharge from the valve unit have been developed in the past. Such valve units are shown, for example, in my co-pending application Ser. No. 005,312 filed Jan. 22, 1979 and entitled "Water Treatment Apparatus" and in U.S. Pat. Nos. 3,342,335 and 3,428,089.

SUMMARY OF THE INVENTION

It is a principal object of the present invention to provide a valve unit adapted to be attached to a faucet and that will, in addition to providing for essentially uninterrupted flow of water from the faucet through the valve unit and alternative flow from the valve unit to a water purification unit and back to the valve unit before being discharged, provide flow to a drinking fountain formed as part of the valve unit.

Other objects and features are to provide such a valve that is economically constructed, reliable and easily repaired.

Still another object is to provide a valve unit that can be readily attached to a faucet and that can be readily arranged so that a drinking faucet portion of the valve unit is properly positioned for use.

Principal features of the invention include a valve housing with a reciprocating spool to control flow directly through the housing or to discharge, and another spring loaded spool valve to regulate flow to a drinking fountain portion of the valve unit.

Additional objects and features of the invention will become apparent from the following detailed description and claims taken together with the accompanying drawings.

THE DRAWINGS

In the Drawings

FIG. 1 is a rear elevation view of the housing of the invention;

FIG. 2, a side elevation view;

FIG. 3, a top plan view;

FIG. 4, a bottom plan view with the filter screen and the screen retainer removed for clarity;

FIG. 5, a vertical section, taken on the line 5—5 of FIG. 2;

FIG. 6, a vertical section, taken on the line 6—6 of FIG. 1;

FIG. 7, a horizontal section, taken on the line 7—7 of FIG. 1; and

FIG. 8, an exploded perspective view of the valve unit of the invention.

DETAILED DESCRIPTION

Figure 3:
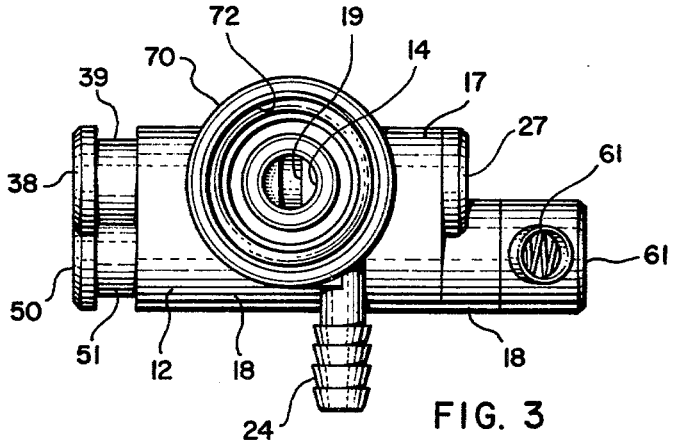
Figure 1:
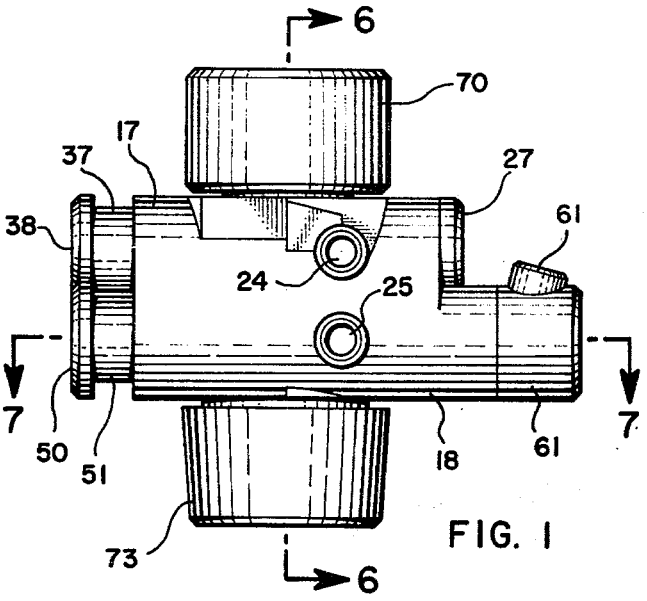
Figure 2:
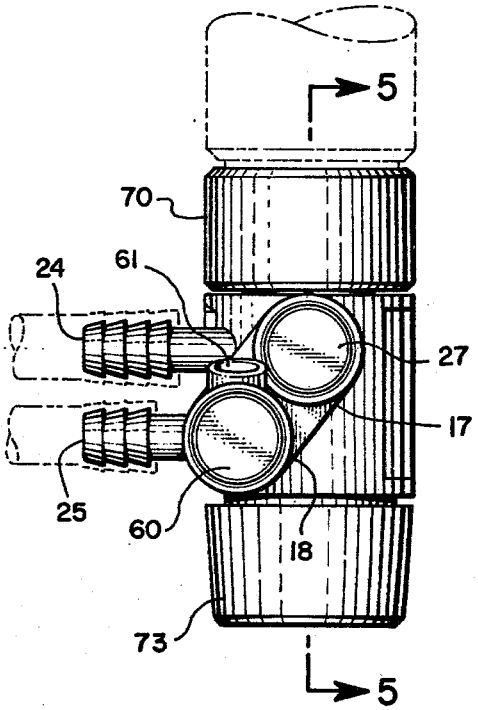

Referring not to the drawings:

In the illustrated preferred embodiment, the valve unit of the invention, shown generally at 10 includes a housing 11 that is preferably injection molded from a suitable plastic material. The housing 11 has a central body 12, with a threaded nipple 13 around an inlet passage 14 and a discharge opening 15. The body is threaded at 16 around the discharge opening.

A pair of parallel barrels 17 and 18 extend through the body 12. Barrel 17 is positioned near the inlet end of the valve body and has an upper opening 19 thereinto that is centrally aligned with and that opens to the inlet passage 14.

The barrel 18 is parallel to the barrel 17 but is below and offset rearwardly from the barrel 17 with respect to discharge opening 15.

Figure 4:
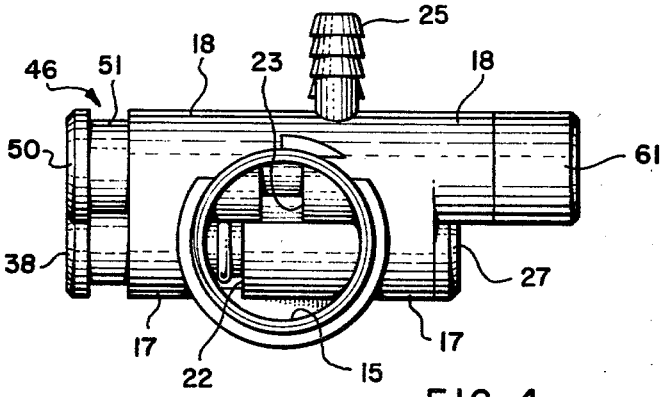

A port 22 communicates the interior of barrel 17 with the interior of passage 14 at one side of the passage 14 and a port 23 FIG. 4, similarly communicates the interior of barrel 18 with the central interior of passage 15.

A pair of hose fittings 24 and 25 project from the body 12 and openings through the fittings respectively open to the interiors of barrels 17 and 18.

A spool 26 fits in the barrel 17 and is arranged to control flow from the inlet passage 14, opening 19, through the barrel 17, port 22 and discharge opening 15. The spool 26 includes a cap 27 having a head 28 at one end and a body 29 adapted to fit snugly in the barrel 17. An O-ring 30 fits in a groove provided therefore around the body 29 to prevent leakage from the interior of the barrel past the O-ring 30.

A reduced central section of the spool 26 is snap fitted into and extends from the body 29 and includes a pair of shoulders 31 and 32, separated by a reduced portion 33. The shoulders 31 and 32 have O-rings 34 and 35, respectively, mounted in grooves formed therearound to engage the wall of a reduced section of the barrel 17. A tapered locking member 36 projects from the shoulder 32 and a cap 37 snaps into locking engagement with the tapered locking member to fix the spool in the barrel 17. Cap 37 includes a head 38 and a body portion 39 that fits snugly in the barrel 17. An O-ring 40, in a groove provided therefore around the body portion 39 engages the barrel 37 to prevent leakage from the interior of the central body 12 past the body portion 39.

Figure 5:
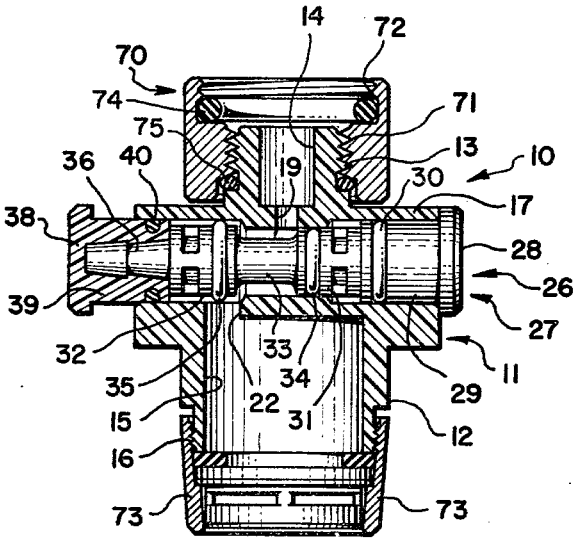
Figure 6:
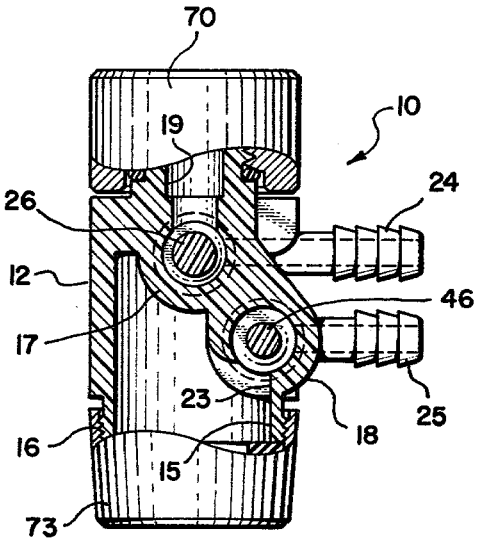
Figure 7:
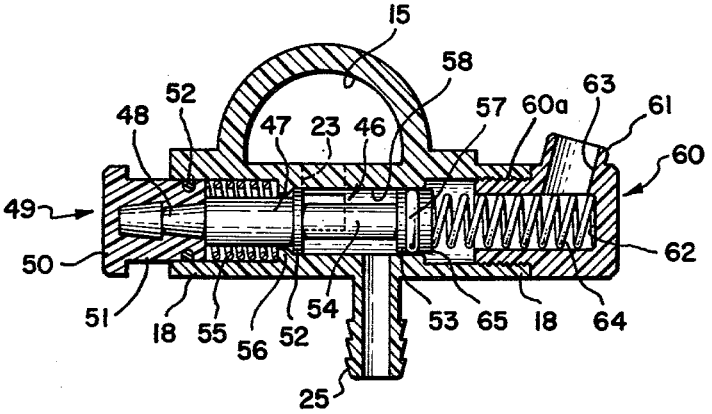
Figure 8:
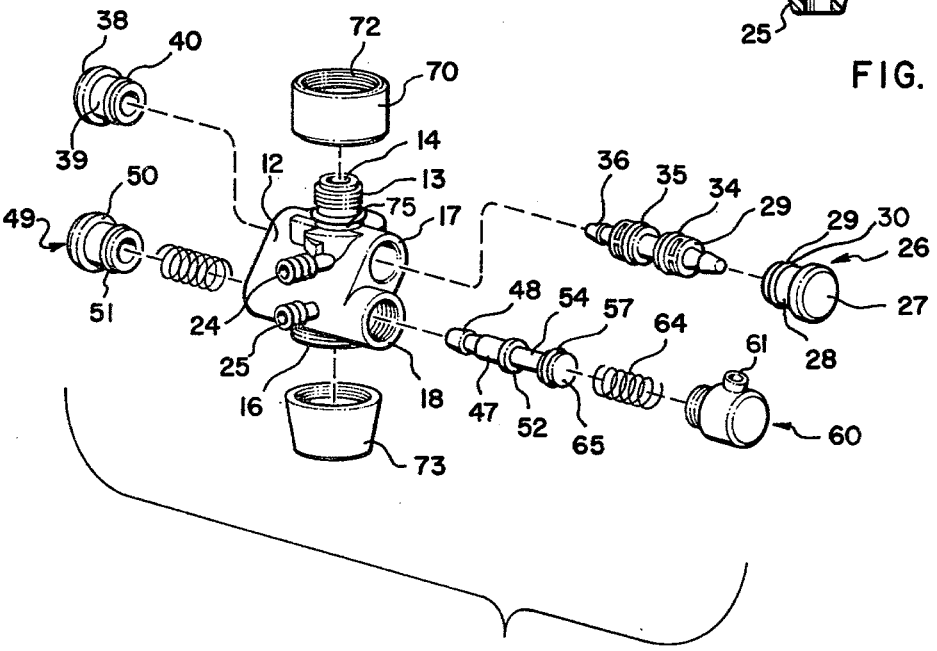

As is best seen in FIGS. 5 and 6, when the spool 26 is moved to one extreme position where the head 28 abuts the central body 12 a flow passage is opened from inlet passage 14 through opening 19, around the reduced portion 33 of spool 26, through the port 22 and out the discharge opening 15. At the same time, the shoulder 31 and O-ring 34 block flow to the hose fitting 24. When the spool 26 is moved to its other extreme position, with the head 38 abutting the central body 12 the O-ring 35 blocks flow to the port 22 and the flow from inlet passage 14 and opening 19 is past the reduced portion 33 of spool 26 to the hose fitting 24. Return flow through hose fitting 25 (after flow is directed through a water passage 15 or a drinking fountain spout, as will be further explained.

A spool 46, comprising a stem 47, having a tapered locking member 48, and a cap 49 snapped into engagement with the tapered locking member extends into the barrel 18. Cap 49 includes a head 50 and a body portion 51 that has an O-ring 52 in a groove formed therearound and engaging the barrel to prevent flow therepast. The stem 47 has a pair of collars 52 and 53 formed thereon and a reduced stem portion 54 between collars.

A spring 55 fits around the stem 47 and acts between a shoulder 56 formed in barrel 18 and body portion 51 to bias the head 50 away from the end of barrel 18. The collar 52 engages the shoulder 56 to limit the extent to which spring 55 can bias the spool 46. When the spool 46 is fully biased by spring 55, port 23 is fully opened and full flow is permitted from hose fitting 25, past the reduced portion 54 of the spool 46, through port 23 and out discharge passage 15.

An O-ring 57 fits in a groove provided therefor in collar 53 to sealingly engage a reduced inner section 58 of barrel 18 when the spool 46 is in its fully biased position.

A cap unit, shown generally at 60, including the drinking fountain spout 61 is tightly fitted into the barrel 18. The cap unit has exterior ribs **60*a* therearound adapted to hold the unit in the barrel 18 while allowing it to be rotated and a blind bore 62 extending thereinto. The drinking fountain spout 61 extends angularly from the cap and the bore 63 thereof intercepts the blind bore 62. A spring 64 fits in blind bore 62 and abuts the end 65 of spool 46 opposite to the cap when the spool is fully biased by spring 55. The spring 64 assists the spring 55 in biasing the spool and, in some instances, may be used in place of spring 55. In addition, the spring 64** serves as a diffuser to reduce turbulence to the drinking fountain.

In using the drinking fountain, with the spool 26 positioned such that flow is to the hose fitting 24, and with flow from the hose fitting 25 into barrel 18, cap 49 is pushed to move the spool against the bias of the springs 55 and 64. This moves O-ring 57 out of engagement with the reduced inner section 58 of barrel 18 and opens up flow from hose fitting 25 past the collar 53, O-ring 57, through the barrel 18 and past spring 64 to discharge out bore 63. The position of collar 42 relative to the post 23 determines the amount of flow from the fitting 25 that will be discharged from the bore 63. Thus, if the spool is pushed to move the collar 52 fully past port 23 all of the flow from fitting 25, except that portion passing between the outer edge of collar 42 and the wall of the barrel 17 will be diverted out bore 53. A user can readily control the flow through bore 63 by controlling the pushing force applied to cap 49.

While it may be that nipple 13 will thread directly into a faucet, it has been found that for many installations the adapter 70 is required. Adapter 70 is interiorly threaded at 71 to receive the threads of nipple 13 and has an enlarged, interiorly threaded portion 72 to be threaded onto the exterior threads of a faucet.

A conventional strainer and diffuser assembly 73 may be connected to threads 16 to filter and reduce turbulence in the water discharged through outlet passage 15.

From the foregoing, it should be apparent that a valve unit has been provided that will attach to a faucet and that will allow flow of water directly through the valve unit or that can be operated to direct flow through a water purification unit, or the like, and then back through the valve unit for discharge therefrom. In addition, the valve unit will provide a drinking fountain, with user operated controls to regulate the amount of water diverted to the drinking fountain from the flow of water going to the water purification unit and then back to the valve unit.

The offset relationship of the barrels 17 and 18 and their respective spools 26 and 46 permit easy operation of the spools and insure that water discharged through the drinking fountain will not be obstructed by the spool 26. Barrel 18 is also preferably extended beyond barrel 17 a distance corresponding to the distance between the surface of cap 49 on which a user pushes and the end of barrel 17 so that the drinking fountain will at all times be positioned beyond the cap 49. As noted, the cap unit 60 is retatable with respect to barrel 18 to allow the spout 61 to be properly directed for convenient use.

O-rings 74 and 75, respectively positioned inside adapter 70 and around nipple 13 permit the valve unit 10 to be positioned with respect to a faucet such that flow through the spout 61 will be properly directed while still providing a water-tight seal at the connection.

Although a preferred embodiment of my invention has been herein disclosed, it is to be understood that the present disclosure is by way of example and that variations are possible without departing from the subject matter coming within the scope of the following claims, which subject matter I regard as my invention.

I claim:

1. A valve unit for attachment to faucets and the like, said valve unit comprising a housing having an inlet passage and an outlet passage;

a pair of parallel barrels formed in said housing and extending through said inlet and outlet passages;

a hose fitting opening opening into each of said barrels;

port means connecting the inlet passage to the interior of a first one of said barrels;

port means connecting the interior of the first one of said barrels to the outlet passage;

port means connecting the interior of the other barrel to the outlet passage;

means in the first barrel to direct liquid from the inlet passage through the first barrel to the outlet passage, or from the inlet passage, through the barrel to the hose fitting opening into the first barrel; and means in the other barrel, said means including a drinking fountain port, to direct liquid from the hose fitting opening into said barrel to the outlet passage or to the drinking fountain port.

2. A valve unit as in claim 1, wherein the hose fittings extend from a rear of the housing, the first barrel is above the second barrel and closer to the inlet passage and the second barrel is offset rearwardly from the first barrel.

3. A valve unit as in claim 2, wherein the means in the first barrel to direct liquid comprises a spool with a reduced central section and caps snapped onto each end thereof, said caps respectively engaging the ends of the first barrel to limit travel of the spool in the barrel.

4. A valve unit as in claim 3, wherein the means in the other barrel to direct liquid from the hose fitting opening into said other barrel to the outlet passage comprises a spool having a reduced central section extending into the other barrel and having a cap snapped onto one end to engage the end of the other barrel, spring means biasing said cap away from the end of said other barrel to thereby position the reduced central portion of the spool whereby flow is directed through the outlet passage; and the drinking fountain port is at the end of said other barrel whereby movement of said spool against the bias of the spring means will divert flow from the outlet passage to the drinking fountain port.

5. A valve unit as in claim 4, wherein the drinking fountain port at one end of the other barrel is formed by a spout that is rotatable with respect to the other barrel.

6. A valve unit as in claim 3, wherein the drinking fountain port is formed by a spout that is rotatably mounted with respect to the other barrel.

7. A valve unit as in claim 2, wherein the drinking fountain is at one end of the other barrel.

* * * * *